United States Patent [19]

Yakunin et al.

[11] Patent Number: 4,994,176

[45] Date of Patent: Feb. 19, 1991

[54] GRAVITY CONCENTRATOR HAVING SECONDARY WASH OF HEAVY FRACTION

[76] Inventors: Alexandr I. Yakunin, ulitsa Anosova, 47, kv. 20; Boris V. Pilat, I mikroraion, 21a, kv. 63; Edil K. Galimzhanov, ulitsa Dekarta, 37, kv. 46, all of, Alma-Ata, U.S.S.R.

[21] Appl. No.: 340,896

[22] Filed: Apr. 19, 1989

[30] Foreign Application Priority Data

Apr. 21, 1988 [SU] U.S.S.R. ..... 4430896

[51] Int. Cl.[5] ..... B03B 5/66

[52] U.S. Cl. ..... 209/157; 209/210

[58] Field of Search ..... 209/18, 132, 155, 157–159, 209/172, 173, 208, 210, 211

[56] References Cited

U.S. PATENT DOCUMENTS

| | | | |
|---|---|---|---|
| 2,634,741 | 4/1953 | Fontein | 209/173 X |
| 3,415,373 | 12/1968 | Pink et al. | 209/210 X |
| 4,157,951 | 6/1979 | Park . | |

FOREIGN PATENT DOCUMENTS

| | | | |
|---|---|---|---|
| 2747192 | 4/1978 | Fed. Rep. of Germany . | |
| 3440108 | 5/1986 | Fed. Rep. of Germany . | |
| 0110241 | 6/1958 | U.S.S.R. . | |
| 0147976 | 12/1962 | U.S.S.R. . | |
| 0581991 | 12/1977 | U.S.S.R. | 209/157 |
| 1220692 | 3/1986 | U.S.S.R. | 209/157 |
| 0451942 | 8/1936 | United Kingdom | 209/159 |
| 0456895 | 11/1936 | United Kingdom | 209/155 |
| 2003756 | 3/1979 | United Kingdom . | |

*Primary Examiner*—Margaret A. Focarino
*Assistant Examiner*—Edward M. Wacyra
*Attorney, Agent, or Firm*—Burgess, Ryan & Wayne

[57] ABSTRACT

A concentrator has an inclined hollow casing and a separating chamber communicating therewith having a pipe for supplying a material being handled, a pipe for discharging heavy fraction of the material being handled and a first pipe for supplying a separating fluid. A second pipe for supplying the separating fluid connects to the pipe for discharging heavy fraction.

8 Claims, 1 Drawing Sheet

GRAVITY CONCENTRATOR HAVING SECONDARY WASH OF HEAVY FRACTION

FIELD OF THE ART

The invention relates to the field of separation of solids with the aid of a liquid, in particular, water in the gravity field, and more specifically, it deals with concentrators.

FIELD OF USE

The invention may be used for the separation of particles having different density or size in the mining, chemical, petroleum industries where it is possible to sort out particles by fractions.

The problem of exhaustion of ore deposits and placers, the everdecreasing content of useful components call for evergrowing volumes of ore to be involved in processing so as to cope with the mankind demand in metals, especially heavy metals such as gold, platinum, tungsten, lead, tin bearing in mind the growing demand in these metals as well as their natural compounds such as sulfides.

The evergrowing requirements imposed on ecology, constant rise of electric energy cost, shortage of water resources at mineral mining sites make it possible to ensure a clear distinction between primary methods of concentration of mineral raw materials. The gravity concentration methods are out of competition from this point of view.

Jigging machines, concentrator tables and auger locks are among most widely known apparatuses for gravity concentration. All these apparatuses are of low productivity, and the former apparatuses consume much water and electric energy.

Therefore, there is a problem of providing radically new concentrators that can ensure minimized water and electric energy consumption with high degree of separation of particles.

Operation of the majority of commercial apparatuses is based on the difference between velocities of free and confined fall of particles of a material being handled having different mass in a liquid, e.g. in water or slurry. The material being handled is subjected to various perturbations, e.g. oscillations or vibrations in various planes and pulsations.

Such perturbations imposed upon a continuously moving flow of a material being handled in a confined space are caused locally within a short portion and allow massive particles (coarse gold particles, platinum, bismuth, tungsten and tin minerals) to be successfully separated into heavy fraction. However, fine particles within the range from 5 to 500 μm, including ultrafine particles (5–40 μm) cannot be concentrated to heavy fraction and form light fraction to be usually irrecoverably lost. It is concentration of fine particles that cannot be achieved altogether in the existing types of concentrators.

BACKGROUND OF THE INVENTION

Known in the art is a concentrator (U.S. Pat. No. 4,157,951), comprising a hollow vertically extending casing having a pipe for supplying a separating fluid provided adjacent to a bottom end of the casing, a pipe for discharging the separating fluid and light fraction provided adjacent to a top end of the casing, and a pipe for discharging heavy fraction provided adjacent to the bottom end of the casing.

The material being handled is charged into the concentrator together with the separating fluid. An upward flow of the material being handled is created in the casing between the pipe for supplying the separating fluid and the pipe for discharging light fraction owing to the supply of the separating fluid. Light fraction is moved upwards by the flow of the material being handled and is discharged through the pipe for discharging light fraction and heavy fraction of a higher specific gravity is concentrated in the bottom part of the casing and is discharged through the pipe for discharging heavy fraction.

The prior art concentrator is suitable for the separation of classified concentrated material. Only a laminar upward flow of the material being handled is created in the casing of the concentrator so that a part of heavy fraction cannot be suspended. This lowers the possibility of preparing a high-grade concentrate. The prior art concentrator does not make use of the effect of friction between particles of the material being handled and the inner surface of the casing, and fine particles of heavy fraction are lost from the concentrator with the upward flow of the material being handled.

The prior art concentrator does not allow high degree of concentration of heavy fraction particles to be achieved in the pipe for discharging heavy fraction, nor does it ensure the control of the degree of concentration of particles of heavy fraction so that efficiency of separation of the material being concentrated is rather low.

Also known in the art is a concentrator (GB,A, No. 2003756), comprising a hollow cylindrical casing which extends in an inclined position having a separating partition which divides the casing into two conjugated chambers communicating with each other through a pipe provided in the partition and extending coaxially with the longitudinal axis of the casing. A top end of the casing has a pipe for supplying a material being handled and a bottom end of the casing has a pipe for discharging heavy fraction. In addition, the casing is provided with an auxiliary tangentially positioned pipes for supplying and discharging a separating fluid and light fraction.

All the material being handled is in a turbulent flow and in a suspended state in the prior art concentrator so that high quality of separation of particles of heavy and light fractions cannot be ensured.

The prior art concentrator cannot ensure a high degree of concentration of heavy fraction particles in the pipe for discharging heavy fraction either, nor does it provide for the control of the degree of concentration of heavy fraction particles in concentrating various kinds of mineral raw materials.

The most similar to the invention is a concentrator (GB, A, No. 2164589), comprising an inclined elongated hollow casing for receiving a material being handled having a pipe for supplying the material being handled, a pipe for supplying a separating fluid and pipes for discharging light and heavy fractions of the material being handled.

This prior art concentrator involves the creation of a number of successive turbulent zones in which heavy and light fractions are separated. Fine particles of heavy fraction do not have time to move to the bottom of the concentrator and are lost together with light fraction. This does not allow hydrodynamic conditions of separation of fractions of the material being concentrated to be optimized and, in particular, a flow of the material being handled cannot be created with a local turbulence gradually turning to laminar flow accompanied by a wall boundary layer effect. The prior art concentrator does not make it possible to achieve a high degree of concentration of heavy fraction particles in the separating chamber and in the pipe for discharging heavy fraction, nor does it allow the degree of concentration of heavy fraction particles to be controlled during concentration of various kinds of mineral raw materials.

It is an object of the invention to enhance efficiency of separation of a material being handled into light and heavy fractions.

SUMMARY OF THE INVENTION

The object of the invention is accomplished by a concentrator which comprises an inclined elongated hollow casing for receiving a material being handled, at least a first pipe and a second pipe for supplying a separating fluid, a pipe for supplying the material being handled, a pipe for discharging heavy fraction of the material being handled, a pipe for discharging light fraction of the material being handled. The concentrator also comprises a discharge chamber designed for creating a gradient of velocities between flows of the separating fluid and material being handled in this chamber and in the casing and also for providing a surplus of the separating fluid in said chamber thereby enhancing washing of the heavy fraction of the material being handled. The separating chamber extends coaxially with said longitudinal axis of the casing. The interior space of the discharge chamber communicates with the interior space of the casing in its bottom part. The discharge chamber is provided with the pipes for supplying the material being handled extending coaxially with said longitudinal axis of the casing, the pipe for discharging heavy fraction and the first pipe for supplying the separating fluid. The second pipe for supplying the separating fluid connects to the pipe for discharging heavy fraction of the material being handled in the zone of the distal end of the pipe for discharging heavy fraction and is designed for additional washing of heavy fraction in a confined space so as to raise the degree of concentration of particles of heavy fraction of the material being handled.

Novelty resides in the fact that the concentrator comprises the discharge chamber communicating with the bottom part of the casing and having the pipe for supplying the material being handled, the pipe for discharging heavy fraction of the material being handled, the first pipe for supplying the separating fluid. The second pipe for supplying the separating fluid connects to the pipe for discharging heavy fraction in the zone of the distal end thereof.

The use of the concentrator according to the invention allows a compact modular plant to be provided for the concentration of particles of minerals with a wide ranging particle size from 5 to 500 $\mu$m operating continuously, the density of the material being handled also widely ranging from 10 to 80. The degree of concentration of particles in a single concentrator may be as high as 80. The environment is not polluted by operation of such a concentrator. The concentrator consumes minimum amount of water which may be reused. The concentrator does not consume electric power or consumes minimum of such power only. The necessary pressure for supplying the material being handled to the casing of the concentrator ranges from $1 \cdot 10^4$ to $3 \cdot 10^4$ Pa.

BRIEF DESCRIPTION OF THE DRAWINGS

The invention will now be described with reference to a specific embodiment illustrated in the accompanying drawings, in which.

DETAILED DESCRIPTION OF THE INVENTION

Figure 1:
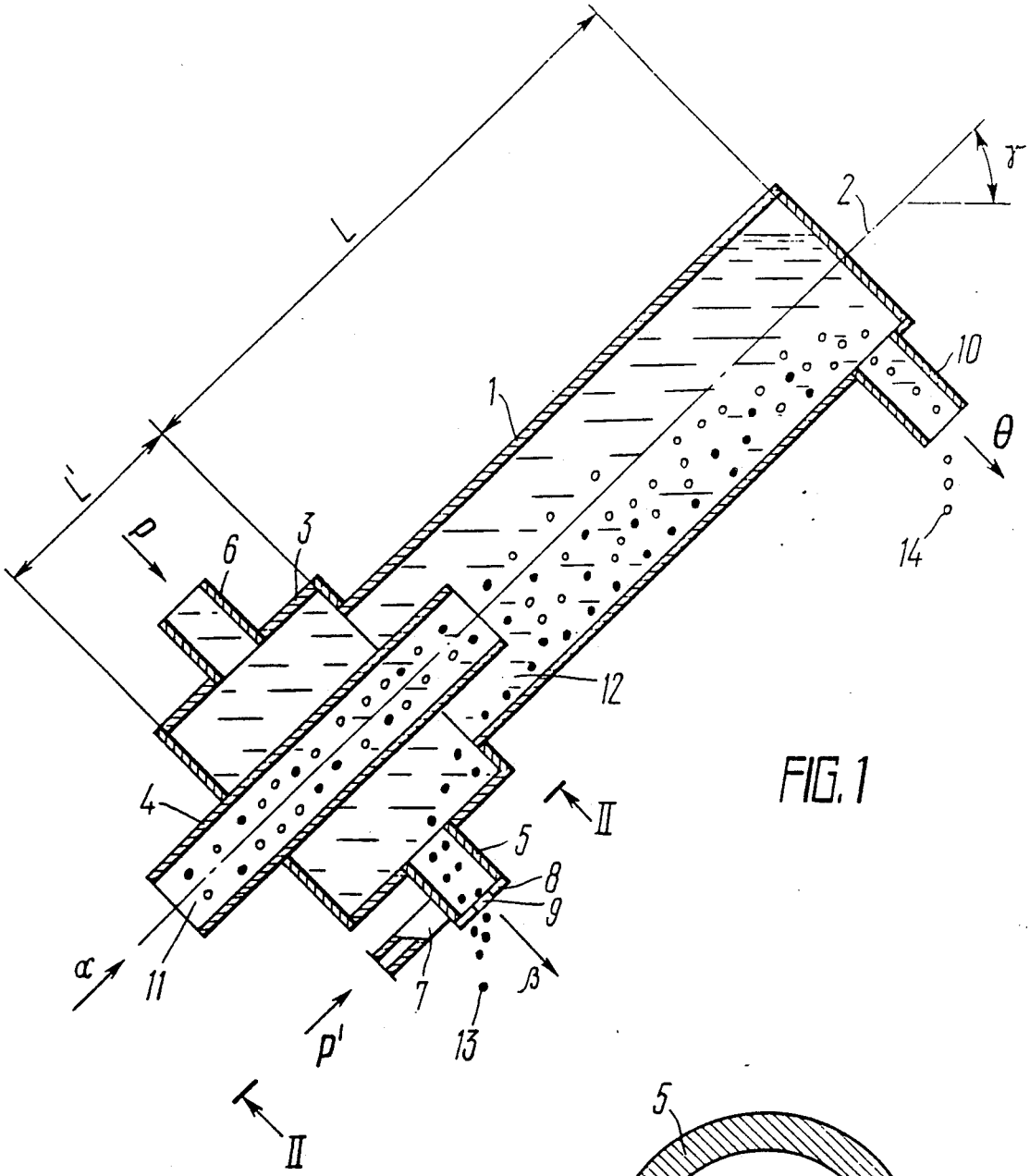
FIG. 1 is a longitudinal sectional view of a concentrator according to the invention.

A concentrator comprises a hollow casing 1 (FIG. 1) of an elongated shape having a longitudinal axis 2 and extending in an inclined position to a horizontal plane at an angle $\gamma$. The value of the angle $\gamma$ is chosen between 30° and 85°.

The concentrator comprises a separating chamber 3 connected to a bottom part of the casing and extending coaxially with the longitudinal axis 2 of the casing, the interior spaces of the separating chamber 3 and casing 1 communicating with each other.

The separating chamber 3 is provided with a pipe 4 for supplying a material being handled extending coaxially with the longitudinal axis 2 of the casing 1, a pipe 5 for discharging heavy fraction, and a pipe 6 for supplying a separating fluid. A pipe 7 for supplying the separating fluid is provided on the pipe 5 for discharging heavy fraction of the material being handled to extend tangentially with respect thereto. The interior spaces of these pipes communicate with each other. The pipe 5 for discharging heavy fraction is provided with a cover plate 8 having a calibrated orifice 9 and mounted on the distal end of the pipe 5.

The concentrator is also provided with a pipe 10 for discharging light fraction located adjacent to a top end of the casing 1.

A material 11 being handled is supplied through the pipe 4 as shown by arrow $\alpha$. The pipe 4 for supplying the material being handled is at least partly received in the casing 1 so as to define a space 12 between the outer periphery of the pipe and the inner surface of the casing 1.

A separating fluid is supplied to the discharge chamber 3 through the pipe 6 as shown by arrow P. Heavy fraction 13 is discharged through the pipe 5 as shown by arrow $\beta$. Light fraction 14 is discharged through the pipe 10 as shown by arrow $\theta$.

An additional flow of separating fluid is supplied through the pipe 7 as shown by arrow P' to induce in the pipe 5 perturbations directed as shown by arrow $\omega$ (FIG. 2) acting upon particles of the heavy fraction 13 (FIG. 1) to enhance quality of these particles by removing lighter particles.

The calibrated orifice 9 in the cover plate 8 makes it possible to control the rate of discharge of the heavy fraction 13 from the pipe 5 and character of perturbations induced by the flow of separating fluid through the pipe 7 in the pipe 5.

The ratio of the cross-sectional area of the discharge chamber 3 to the cross-sectional area of the casing 1 ranges from 1.1 to 3.

The ratio of a length L of the casing 1 to a length L' of the discharge chamber 3 ranges from 3 to 10.

Figure 2:
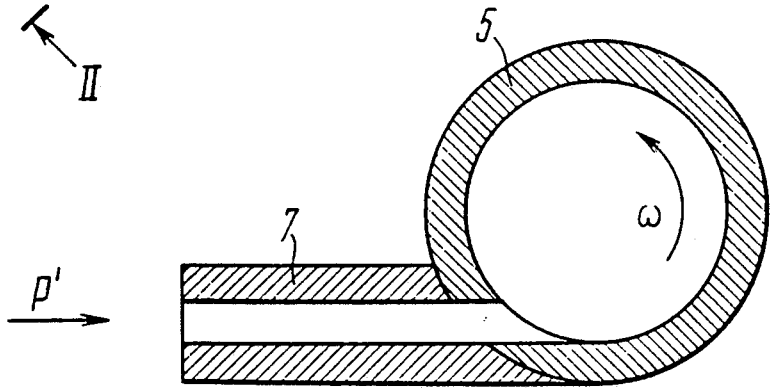
FIG. 2 is an enlarged sectional view taken along line II—II in FIG. 1 according to the invention.

FIG. 2 shows a sectional view taken along line II—II in FIG. 1.

The pipe 7 for supplying the separating fluid extends tangentially with respect to the pipe 5 for creating rotating flows of the separating fluid and heavy fraction in the pipe 5 as shown by arrow $\omega$. The rotating flows contribute to the separation of particles of the light fraction 14 from the heavy fraction 13 so as to enhance efficiency of separation of these fractions.

The concentrator functions in the following manner.

The material 11 being handled (FIG. 1) which is in the form of a mixture of particles of mineral and a liquid is supplied through the pipe 4 for supplying the material being handled into the interior of the casing 1. A separating fluid, e.g. water is supplied through the pipe to the discharge chamber 3 to be mixed with the material 11 being handled in the casing 1. Turbulent vortices thus form in the flow of the material 11 being handled owing to non-homogeneity of the material at the moment it is mixed with water. The resultant mixture is suspended as a result of turbulent swirling, particles within the body of the material 11 being handled being separated. The settling solid grains forming the heavy fraction 13 are discharged through the space 12 into the discharge chamber 3 and further through the pipe 5 using as carrier flow the part of the liquid supplied to the discharge chamber 3 of the concentrator through the pipe 6. Light particles of the material 11 being handled, i.e. the light fraction 14, entrained with the flow of the material 11 being handled which moves up along the inclined casing 1 under confined conditions are removed into the pipe 10 for discharging light fraction. During movement of the material 11 being handled along the inclined casing 1 the material 11 being handled is separated into fractions under the action of gravity, friction forces, buoyancy and forces of resistance to movement of mineral particles in the material being handled caused by viscosity of the material being handled. The heaviest particles 13 of the material 11 being handled that get under gravity into the wall boundary layer of the casing 1 move in the opposite direction with respect to the flow of the material 11 being handled in the casing 1. The formation of the wall boundary layer is caused by friction between the flow of the material 11 being handled and separating fluid and the inner surface of the casing 1. The presence of local turbulence caused by the inner surface of the casing 1, outer periphery of the pipe 4 for supplying the material being handled and water flow contributes to the cleaning of the heavy particles 13 moving within the wall boundary layer. When the heavy particles 13 get into the space 12 where they are mixed with the water flow, additional cleaning of these particles occurs owing to a local turbulence caused by non-uniformity of properties of the material 11 being handled at the moment it is mixed with water. Particles of the heavy fraction 13 get from the space 12 into the discharge chamber 3 having its cross-sectional area which is greater than the cross-sectional area of the casing 1.

Particles of the heavy fraction 13 then get into the pipe 5 where they are additionally cleaned from lighter particles under the action of flow of the separating fluid supplied through the pipe 7. The separating fluid is admitted through the pipes 6 and 7 to the discharge chamber 3 where a surplus of the separating fluid over the material being handled is created in a local space. This contributes to the washing of the material being handled, and predominantly of heavy fraction particles. Gradient of velocities in the discharge chamber 3 and casing 1 contributes to an increase in concentration of particles of heavy fraction in the discharge chamber 3 and pipe 5. The provision of the calibrated orifice 9 in the cover plate 8 allows perturbation flows to be controlled by varying the upward flow of the separating fluid in the pipe 5.

Therefore, the employment of the concentrator according to the invention allows the degree of concentration of heavy fraction particles of the material being handled to be increased and quality of heavy fraction to be controlled.

The ratio of the cross-sectional area of the discharge chamber 3 to the cross-sectional area of the casing 1 ranges from 1.1 to 3. This contributes to the creation of optimum gradient of velocities of the flow of the separating fluid within the discharge chamber 3 and space 12. This results in an intensive cleaning of particles of the heavy fraction 13 from the light fraction 14. A decrease in the ratio between the areas below 1.1 would result in a lower gradient of velocity of the flow of discharge fluid within the separating chamber 3 so that particles of the heavy fraction 13 cannot be efficiently cleaned. An increase in the ratio of the cross-sectional areas of the discharge chamber 3 and casing 1 above three is inexpedient as in this case a part of the separating chamber would be filled predominantly with the separating fluid and would practically contain no material 11 being handled. As a result, there would be no separation of the material being handled in the discharge chamber 3.

The ratio of the length of the casing 1 to the length of the discharge chamber 3 ranges from 3 to 10 so as to contribute to the provision of an optimum gradient of velocities of flows of the separating fluid and the material being handled while at the same time ensuring an optimum separation of the material being handled in the separating chamber.

With the ratio of the lengths below three the chamber 3 would be filled predominantly with the separating fluid and would contain practically no material being handled so that no separation of the material being handled would take place. As increase in the ratio of these lengths in excess of ten would result in the concentration of the material being handled in both the casing 1 and separating chamber 3 being substantially indentical so that no efficient separation of the material being handled would take place in the chamber 3.

Therefore, an enhanced efficiency of separation of the material being handled is ensured in the concentrator according to the invention owing to the creation of a gradient of velocities of the flows of the separating fluid and material being handled in the separating chamber and casing, owing to a surplus of the separating fluid in the separating chamber and owing to an additional washing of heavy fraction with separating fluid in the pipe for discharging heavy fraction.

We claim:

1. A concentrator comprising:

An inclined elongated hollow casing for receiving a material to be handled having a longitudinal axis and comprising an interior space and a bottom region;

at least a first pipe and a second pipe for supplying a separating fluid to the casing;

a pipe for supplying the material to be handled into said casing;

a pipe having a distal end zone for discharging a heavy fraction of the material to be handled from the casing;

a pipe for discharging the light fraction of the material to be handled from the casing;

a discharge chamber having an interior space in flow communication with the interior space of the casing in said bottom region thereof and being coaxial with the longitudinal axis of the casing, said chamber adapted to create a gradient of velocities between the flows of the separating fluid and the material to be handled in said chamber and in said casing and in the presence of a surplus of the separating fluid to thereby enhance the washing of the heavy fraction of the material to be handled;

said discharge chamber having said pipe for supplying the material to be handled extending coaxially with the longitudinal axis of the casing, and said pipe for discharging the heavy fraction and the first pipe for supplying the separating fluid;

said second pipe for supplying the separating fluid connected to said pipe for discharging the heavy fraction of the material to be handled in said distal end zone of said pipe for discharging the heavy fraction, said second pipe adapted to wash the heavy fraction in a confined space to increase the degree of concentration of the particles of the heavy fraction of the material to be handled.

2. A concentrator according to claim 1, wherein the ratio of the cross-sectional area of the discharge chamber to the cross-sectional area of the casing ranges from 1.1 to 3.

3. A concentrator according to claim 1 or 2, comprising:

a cover plate;

a calibrated orifice in said cover plate;

said pipe for discharging the heavy fraction being provided with said cover plate having said calibrated orifice designed for controlling and optimizing conditions for washing the heavy fraction in the pipe for discharging the heavy fraction.

4. A concentrator according to claim 1, wherein the ratio of the length of the casing to the length of the discharge chamber ranges from 3 to 10.

5. A concentrator according to claim 4, wherein said second pipe for supplying the separating fluid is provided on said pipe for discharging the heavy fraction to extend tangentially with respect to said pipe for discharging the heavy fraction.

6. A concentrator according to claim 4, comprising:

a cover plate;

a calibrated orifice in said cover plate;

said pipe for discharging the heavy fraction being provided with said cover plate having said calibrated orifice designed for controlling and optimizing conditions for washing the heavy fraction in the pipe for discharging the heavy fraction.

7. A concentrator according to claim 1, wherein said second pipe for supplying the separating fluid is provided on said pipe for discharging the heavy fraction to extend tangentially with respect to said pipe for discharging the heavy fraction.

8. A concentrator according to claim 7, comprising:

a cover plate;

a calibrated orifice in said cover plate;

said pipe for discharging the heavy fraction being provided with said cover plate having said calibrated orifice designed for controlling and optimizing conditions for washing the heavy fraction in the pipe for discharging the heavy fraction.

* * * * *